US006276554B1

(12) United States Patent
Lallement et al.

(10) Patent No.: US 6,276,554 B1
(45) Date of Patent: Aug. 21, 2001

(54) PAINT TRAY WITH HOLDING MEANS ENSURING IMPROVED STABILITY

(75) Inventors: Frédéric Lallement; Pascal Fievet, both of La Capelle (FR)

(73) Assignee: Franpin, La capelle (FR)

( * ) Notice: Subject to any disclaimer, the term of this patent is extended or adjusted under 35 U.S.C. 154(b) by 0 days.

(21) Appl. No.: 09/660,941

(22) Filed: Sep. 13, 2000

(30) Foreign Application Priority Data

Sep. 13, 1999 (FR) ..... 99 11420

(51) Int. Cl.[7] ..... B65D 1/36

(52) U.S. Cl. ..... 220/570; 220/23.83; 220/574; 206/1.7

(58) Field of Search ..... 220/736, 570, 220/574, 17.1, 23.83; 206/1.7

(56) References Cited

U.S. PATENT DOCUMENTS

| | | | | |
|---|---|---|---|---|
| 2,661,858 | | 12/1953 | Howell . | |
| 5,511,279 | | 4/1996 | Ippolito . | |
| 5,553,701 | * | 9/1996 | Jarecki et al. | 220/570 X |
| 5,634,568 | * | 6/1997 | Wawrzyniak | 220/574 X |
| 5,641,087 | | 6/1997 | Moffitt . | |
| 5,966,772 | * | 10/1999 | Woodnorth et al. | 220/570 X |

FOREIGN PATENT DOCUMENTS

95/26304 10/1995 (WO) .

* cited by examiner

*Primary Examiner*—Steven Pollard
(74) *Attorney, Agent, or Firm*—Jacobson Holman, PLLC

(57) ABSTRACT

A paint tray whose bottom wall forms an elevation defining two cavities on respective opposite sides of the elevation. The tray is held by means of a portion of the tray that extends downward. The portion of the tray that extends downward is an undulation of its bottom wall which simultaneously forms a fluid connection channel between the two cavities.

11 Claims, 2 Drawing Sheets

PAINT TRAY WITH HOLDING MEANS ENSURING IMPROVED STABILITY

BACKGROUND OF THE INVENTION

1. Field of the Invention

The invention relates to paint trays, in particular paint trays for use with paint rollers.

2. Description of the Prior Art

Paint trays are generally rectangular and wide enough for a paint roller to be inserted in them. The bottom of the tray forms a sloping wall which runs down into a cavity containing the paint, so that the user can roll the paint roller along the sloping wall until the paint roller dips into the paint. The dipped paint roller is also rolled along the sloping wall to wring it out and distribute the paint on it homogeneously.

The top face of the sloping wall advantageously has a multitude of protrusions which catch on and therefore rotate the paint roller and which also encourage wringing out of the paint roller when the paint roller is pressed hard enough against the sloping wall.

The document WO 95 26 304 proposes a paint tray whose depth decreases and then increases again in the lengthwise direction of the tray. The variation in the depth of the tray is the same across all of its width so that this movement of the bottom face forms a bar on the top face which divides the tank into two cavities.

To be more precise, the variation in depth is caused by an undulation of the bottom wall of the tank in the shape of the upper lobe of a sinusoid. The bottom of the tank therefore has in its central part an arch shape whose underside forms a bottom passage across the entire tray.

The two upper flanks of the undulation form slopes along which the paint roller is rolled to impregnate it or wring it out and the bottom passage formed by the arch is used to position the tray on the user's forearm. The bottom of the tray therefore has a rounded concave shape and the surface bearing on the user's arm is therefore particularly large and ensures improved stability.

The above document discloses a tongue extending downward from the upper edge of the tray in front of one end of the transverse bottom passage, so that the user can hold the tongue in their hand when their forearm is under the tray and the tray can be held more securely by grasping the tongue.

A device of the above kind is difficult to keep horizontal and there is an imbalance in the distribution of paint between the two cavities.

There is therefore a requirement for a tray that can be held in a stable manner, whose design discourages spillage and which is cheap to make.

SUMMARY OF THE INVENTION

That aim is achieved by virtue of the present invention, which proposes a paint tray whose bottom wall forms an elevation delimiting two cavities on respective opposite sides of the elevation and comprising holding means formed by a portion of the tray extending downward in the form of an undulation of a bottom wall which simultaneously forms a fluid connection channel between the two cavities.

Other features, objects and advantages of the invention will become apparent on reading the following detailed description, which is given with reference to the accompanying drawings.

DETAILED DESCRIPTION OF THE PREFERRED EMBODIMENTS

Figure 1:
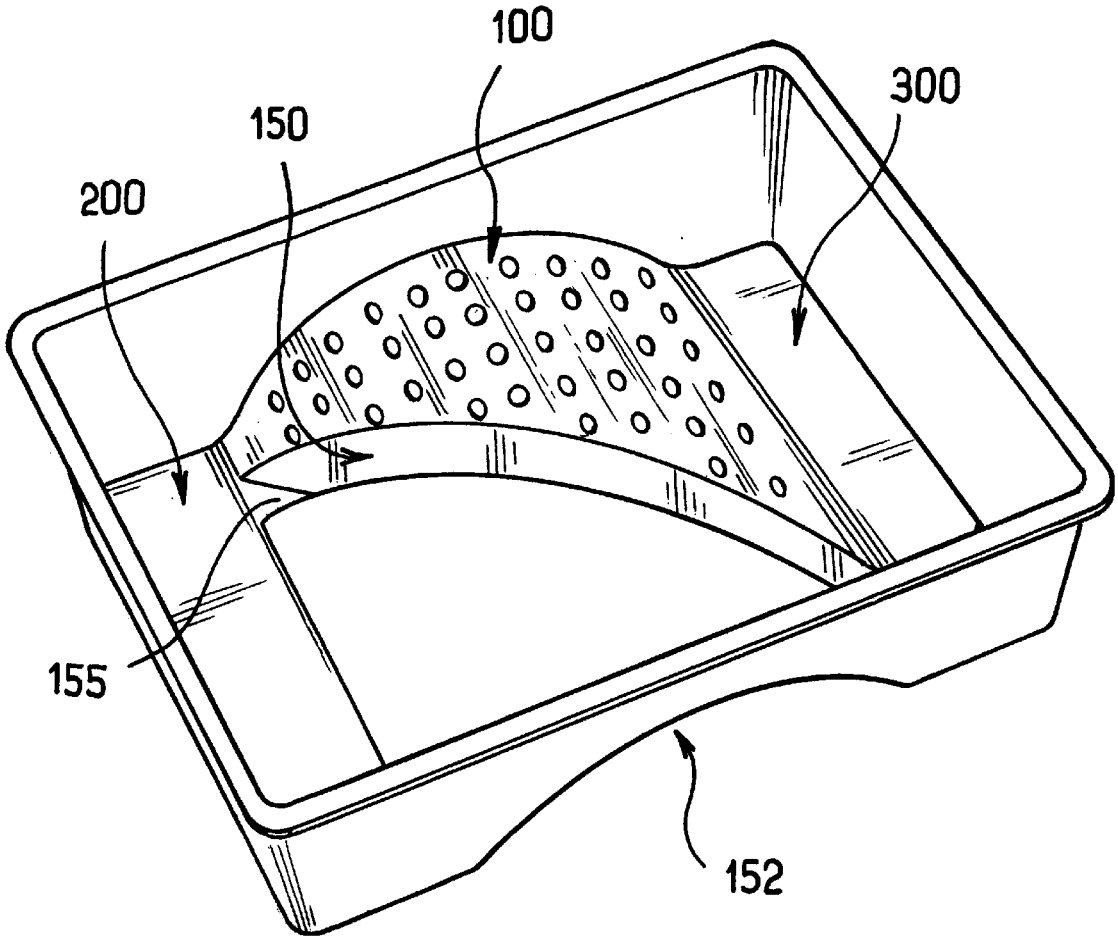
FIG. 1 is a perspective view of a paint tray according to the invention.
Figure 2:
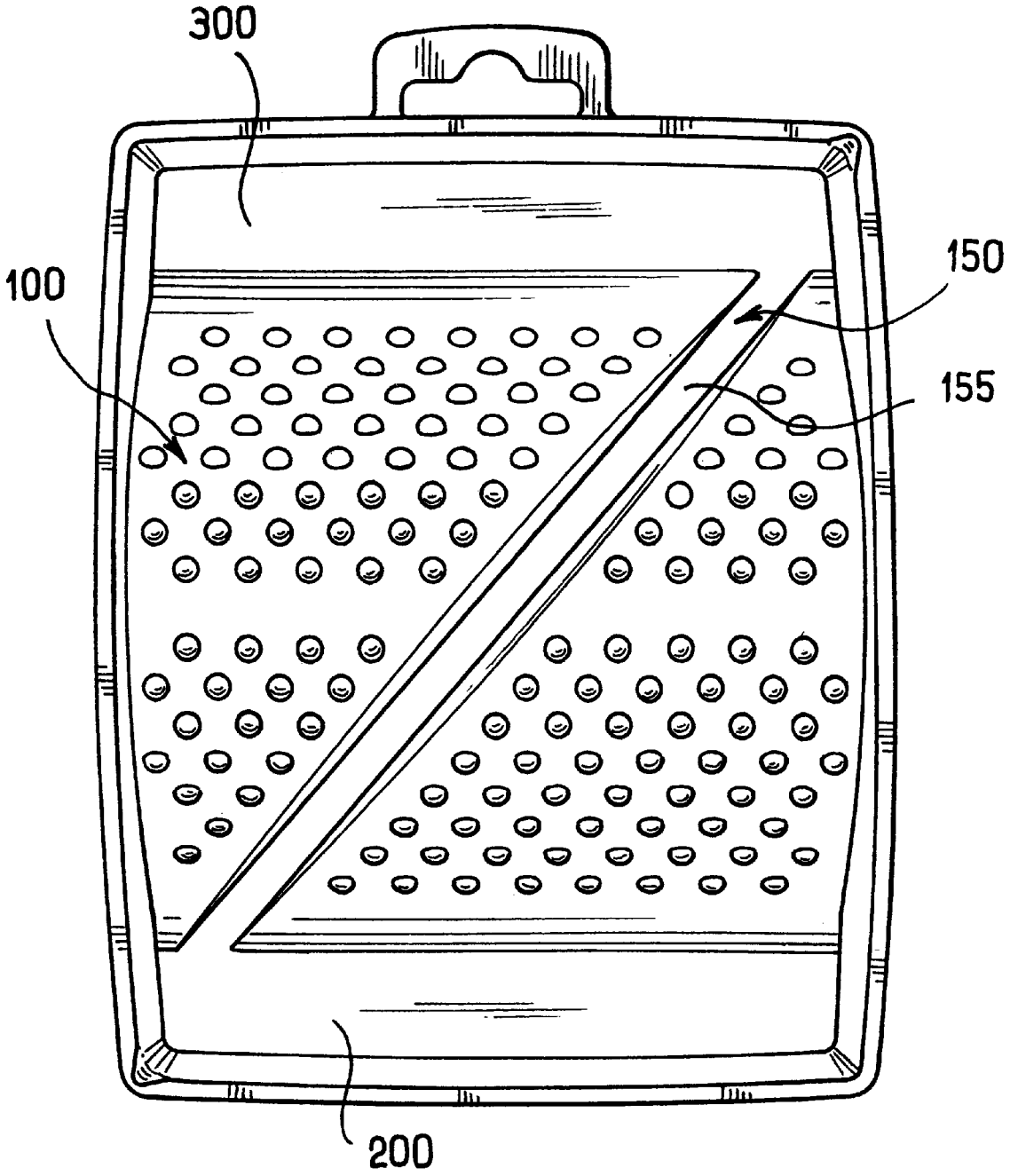
FIG. 2 is a plan view of the same tray.

The paint tray in accordance with the invention takes the general form of a rectangular tray whose bottom has a central elevation 100 in the form of an undulation dividing the tray into two main cavities 200 and 300.

The elevation 100 is the shape of a portion of a circular cylinder whose axis is perpendicular to the length of the tray. The cylinder portion 100 is joined to the opposite longitudinal edges of the tray by two circular arc junctions to form a separation between the two cavities 200 and 300 of the tray.

Each of the two cavities 200 and 300 extends approximately one quarter of the length of the tray. The central elevation 100 forms an upper protrusion 100 and a bottom cavity 152, over a central zone whose length is half that of the tray.

The height of the elevation 100 is substantially two-thirds the height of the tray and the longitudinal edges of the tray therefore rise above the elevation 100 in approximately the top third of the height of the tray.

Accordingly a paint roller mechanism can be placed on the elevation 100 and a lid for closing the tray placed on top of the combination. More generally, the lid forms with the tray a unit assembly that can be sold and carried with other objects inside the tray. The lid also protects the paint from dust and drying out between two working sessions.

The edge of the tray includes a rim adapted to engage in a peripheral groove on a lid of the above kind and a tab for hanging it at the center of the rim on one side of the tray. In a variant of the tool the tab is dispensed with. It is preferably not formed on the lid, because there would then be a risk of the cover being torn in the store, as it is made from a thin and fragile material.

Here the tray is made in one molded plastics material part and all of its parts are formed by a common continuous wall, which is of constant thickness in the bottom of the tray and in its lateral walls.

The upper surface of the elevation 100 features a multitude of small hemispherical bosses which effectively wring out the paint roller when it is rolled against the elevation 100 and tend to catch on the paint roller and therefore rotate it. The wall has the same thickness in the small bosses as in other parts of the tray.

The two paint cavities 200 and 300 are in fluidic communication because the central elevation 100 itself has an undulation 150 across it to form a channel joining the two cavities 200 and 300. The undulation 150 has two facing, substantially plane and vertical inside flanks which are joined together as a flat horizontal strip 155 at the bottom of the channel 150.

Seen in plan view, the channel 150 has a rectilinear shape and its bottom strip 155 is in the same plane as the bottom of each of the two cavities 200 and 300, which it joins together at its ends.

There can therefore be no difference in paint level between the two cavities 200 and 300.

The channel 150 therefore has a flat bottom and its depth increases toward the center of the arched elevation 100.

More generally, the canal 150 can be an undulation or variation in height within the elevation 100. It forms a protrusion constituting a wall in the cavity 152 formed in the bottom face of the elevation 100. The faces of the wall are the edges of the channel 150.

The vertical wall therefore crosses the bottom cavity 152 and its height increases toward the center of the cavity 152. However, the wall does not project under the tray short of the level of the bases of the two cavities 200 and 300.

The projecting wall therefore forms a particularly ergonomic holding arrangement on the bottom of the tray.

The undulation 150 also crosses the bottom cavity 152 in a direction oblique to the main axis of the cavity or the axis of the cylinder on which the elevation 100 is inscribed.

The channel 150 extends along a diagonal of the tray, in this example at 45° to the axis of the cavity 152, and in a direction that is convenient for holding the tray in the left hand.

That convenient direction is as follows: with the paint tray oriented with the main axis previously referred to vertical, and with the open side of the tray toward the observer, the channel 150 joins the bottom right corner of the tray to its top left corner, rather than the opposite configuration, which would be more suited to holding the paint tray with the right hand.

More generally, the channel 150 extends in a direction such that, looking at the tray in plan view with the axis of the bottom passage vertical, it joins a bottom right part of the elevation to its top left part, making it suitable for holding in the left hand.

The user places the left hand in the bottom cavity with the wrist protruding from one end of the cavity and holds the wall 150, whose direction away from the wrist increases towards the left, in their hand.

The wall is therefore ideally aligned with the fingers and the thumb of the left hand presses against the inside surface of the cavity 150 to form a particularly large bearing surface enabling the tray to be held in a particularly stable manner.

The fact that the undulation 150 is oblique to the axis of the elevation 100 means that the paint roller travels from one end of the channel to the other when it is rolled along the elevation. The presence of the channel does not impede in any way the homogeneous distribution of paint on the paint roller.

Note further that the slot 150 is wide enough to receive a brush lying down when the tray is dry. The diagonal slot provides the maximum space for stowing a brush.

The tray described here is intended for use with a small rabbit's foot type paint roller. To this end it has a width of approximately 15 cm, preferably from 13 cm to 17 cm, a length of 19 cm, preferably from 17 cm to 21 cm, and a height of 5 cm, preferably from 4 cm to 6 cm. Here the elevation 100 has a radius of curvature of approximately 6 cm, preferably from 5 cm to 7 cm. The elevation 100 then has a length as measured in the same direction as the length of the tray of approximately 12 cm. The bottom holding wall formed by the undulation 150 then has a maximum height of approximately 3 cm.

There is claimed:

1. A paint tray whose bottom wall forms an elevation delimiting two cavities on respective opposite sides of said elevation and comprising holding means formed by a portion of said tray extending downward in the form of an undulation of said bottom wall which simultaneously forms a fluid connection channel between said two cavities.

2. The paint tray claimed in claim 1 wherein said elevation forms an arch whose bottom cavity forms a passage across said tray and said undulation forms a bottom protrusion which crosses said bottom passage.

3. The paint tray claimed in claim 2 wherein said bottom protrusion forms a wall which extends obliquely to a main direction of said bottom passage.

4. The paint tray claimed in claim 3 wherein said undulation forms a channel which extends in a direction such that, viewing said tray in plan view with the axis of said bottom passage vertical, said channel joins a bottom right-hand part of said elevation and a top left-hand part of said elevation, so that it is suitable for holding in the left hand.

5. The paint tray claimed in claim 1 wherein said undulation is in a central part of said elevation.

6. The paint tray claimed in claim 1 wherein said undulation has a bottom level with the respective bottoms of said two cavities.

7. The paint tray claimed in claim 1 wherein said elevation has a height less than the edges of said tray by an amount sufficient to enable a paint roller to be placed on top of said elevation and said tray containing a paint roller to be covered with a flat lid.

8. The paint tray claimed in claim 1 wherein said undulation forms a rectilinear channel wide enough to receive a paint brush lying down.

9. The paint tray claimed in claim 1 wherein said undulation forms a channel extending substantially along a diagonal of said tray.

10. The paint tray claimed in claim 1 which has a length from 17 cm to 21 cm, a width from 13 cm to 17 cm and a height from 4 cm to 6 cm.

11. The paint tray claimed in claim 1 provided with a lid.

* * * * *